United States Patent [19]

Tonus

[11] Patent Number: 4,561,234

[45] Date of Patent: Dec. 31, 1985

[54] PRODUCT TYING MACHINE

[75] Inventor: Egidio L. Tonus, Castroville, Calif.

[73] Assignee: California Artichoke and Vegetable Growers Corp., Castroville, Calif.

[21] Appl. No.: 446,121

[22] Filed: Dec. 2, 1982

[51] Int. Cl.[4] ..... B65B 27/10; B65B 13/04

[52] U.S. Cl. ..... 53/399; 53/57; 53/77; 53/417; 53/515; 53/583; 53/586; 100/17; 100/26; 289/2; 289/181

[58] Field of Search ..... 53/57, 73, 79, 138 R, 53/138 A, 139.3, 370, 417, 435, 514, 515, 583, 586, 590; 100/26, 31, 25, 17; 289/2, 5, 18.1

[56] References Cited

U.S. PATENT DOCUMENTS

| | | | |
|---|---|---|---|
| 2,354,410 | 7/1944 | Suelflow | 100/31 |
| 2,682,208 | 6/1954 | Magnuson et al. | 100/26 |
| 2,685,771 | 8/1954 | Magnuson et al. | 100/26 |
| 3,221,640 | 12/1965 | D'Arrigo | 100/5 |
| 3,557,684 | 1/1971 | Glasson | 100/26 |
| 4,095,391 | 6/1978 | Anguiano | 53/515 |
| 4,262,944 | 4/1981 | Branch | 53/515 |

*Primary Examiner*—W. D. Bray

*Attorney, Agent, or Firm*—Townsend & Townsend

[57] ABSTRACT

The present invention is an apparatus and method for bundling and tying a product. A plurality of spaced product carriers are sequentially moved along a conveyor flight. At a first station along said flight, a product tie is inserted into each spaced carrier. Each carrier is then advanced to a second station and a product is inserted therein. Each carrier, containing a product and a product tie, is then advanced along said conveyor flight to a third station where the tie is secured about the product. Thereafter, the tied product is discharged from the apparatus at a delivery station. Tie insertion, conveyor operation, product tying, and product delivery are automatic operations, one in coordination with the other and at a selected rate.

38 Claims, 10 Drawing Figures

PRODUCT TYING MACHINE

BACKGROUND OF THE INVENTION

1. Field of the Invention

The present invention relates to an apparatus and method for bunching and tying products. More particularly, the present invention relates to an apparatus and method for bunching and tying vegetable products, such as broccoli.

2. Description of the Prior Art

Inventors have had a tangled relation with product tying machines for sometime. Early tying machines used a swinging arm to wrap a piece of twine or bailing wire around a product. See, for example, Radeck, U.S. Pat. No. 2,346,786, issued Apr. 18, 1944. Such machines involved many moving parts and complex gears, levers, and cams to operate. An additional problem with such machines is that they were delicate and often jammed in the abusive environment in which they were used. Particularly, certain products, such as broccoli or asparagus, produce a considerable amount of fine debris that clogs the operating mechanism of such machines. Build-up of debris is particularly acute during sustained production periods.

Due to the sensitivity and complexity of early tying machines, most product and vegetable packers have used machines for bunching purposes only—loading and tying were done manually. Typical of such devices is U.S. Pat. No. 4,095,391 issued to Anguiano on June 20, 1978. Devices of this type are still the most commonly used for product bunching.

One problem with manual tying is that it makes product packaging a labor intensive activity. The rising costs of labor, coupled with the relatively slow speed at which manual laborers are able to accomplish their tasks, make such common bunching machines relatively inefficient.

Although the problems of product bunching and tying have long been appreciated, those working in the art have failed to produce a reliable, rugged, and efficient alternative to the complicated mechanical tiers and labor intensive bunching devices. The rising costs of agricultural production are not being evenly paced by the market price received for the products. As profit margins become smaller and smaller, efficiencies must be improved if those in the business of bringing a product to market are to remain in business.

SUMMARY OF THE INVENTION

The present invention provides a rugged, durable, labor efficient product bunching and tying apparatus and method for using same. To this end a plurality of spaced product carriers are moved about a conveyor flight circuit at a preselected rate. A product tie is preinserted into each carrier as empty carriers are advanced about the conveyor circuit. A product is then inserted into each carrier at a product insertion station, after which the carrier containing the product and the preinserted tie is moved to a product tying station. The tie is secured about the product at the product tying station and the carrier then moves the tied product to a discharge or delivery station. After the tied product is discharged the empty carrier returns along the conveyor circuit to the tie insertion station and the process begins anew.

The present invention provides for parallel operation of each step in the product bunching and tying process.

After the apparatus is in operation, ties are inserted into empty carriers at the same time that the product is inserted into carriers containing preinserted ties. As this is occurring, carriers containing product and tie are moved to the product tying station for tying and tied products are discharged at a delivery station. Thus, tie insertion, product insertion, product tying, and product delivery are all accomplished simultaneously.

The only step in the operation of the present apparatus that may require labor input is that of product insertion for certain types of products, such as agricultural products. Apparatus rate of operation is adjustable to pace the rate at which the product is inserted into a product carrier. The product is delivered to the insertion station at a rate commensurate with that of product insertion into empty carriers.

The product insertion station includes a knurled wheel and pinch roller for advancing a strip of product tie from a tie strip roll into a tie holder. The tie holder provides a retractable cover that is closed during tie insertion therein and that is opened, exposing a tie insertion gap, when the tie is to be inserted into the empty product carrier. The tie holder includes a series of spaced magnets for retaining the tie thereto when the tie insertion gap is exposed. A plunger is provided for pushing the tie through the tie insertion gap and into the empty product carrier. The carrier includes a channeled inner surface into which the tie is pressed and to which it is secured by a crimping action.

After tie insertion, the carrier is moved to the product insertion station. Product insertion in the exemplary embodiment of the invention is a manual operation involving removing a product from a product bin and inserting the product into the product carrier. After product insertion therein, the carrier is moved along the conveyor circuit to a tying station.

The tying station includes a product forming and holding assembly that is brought into place about the product to retain it during the tying procedure. A tie pick-up is then lowered toward a product carrier to force the product tie ends toward each other. When proper tie end orientation is obtained, a pair of clamp jaws grab each of the tie ends. The entire clamping mechanism is rotated to twist the tie securely about the product. After the tie is secured about the product, the jaws are removed from the product tie ends and the tied product is delivered to a product discharge point.

The present invention provides for automation of product tying in a simple mechanism that is not subject to jamming or damage in an abusive product delivery environment. Agricultural products having twigs, leaves, dirt, etc. do not adversely effect the operation of the present invention. This is especially true because the tying cycle is always done above a product to be tied such that debris readily drop from the tying mechanism by force of gravity. Such operation is in contrast to prior art tying machines. Additionally, the present invention substantially reduces the amount of labor input required during the product tying process. In this way, there is a substantial reduction in product bunching and tying cost, as well as a reduction in apparatus maintenance cost. The reliability of the apparatus further improves profitability of the packaging process by eliminating significant down time and scheduled maintenance time, along with eliminating the need for maintenance personnel.

DETAILED DESCRIPTION OF A PREFERRED EMBODIMENT

Figure 1:
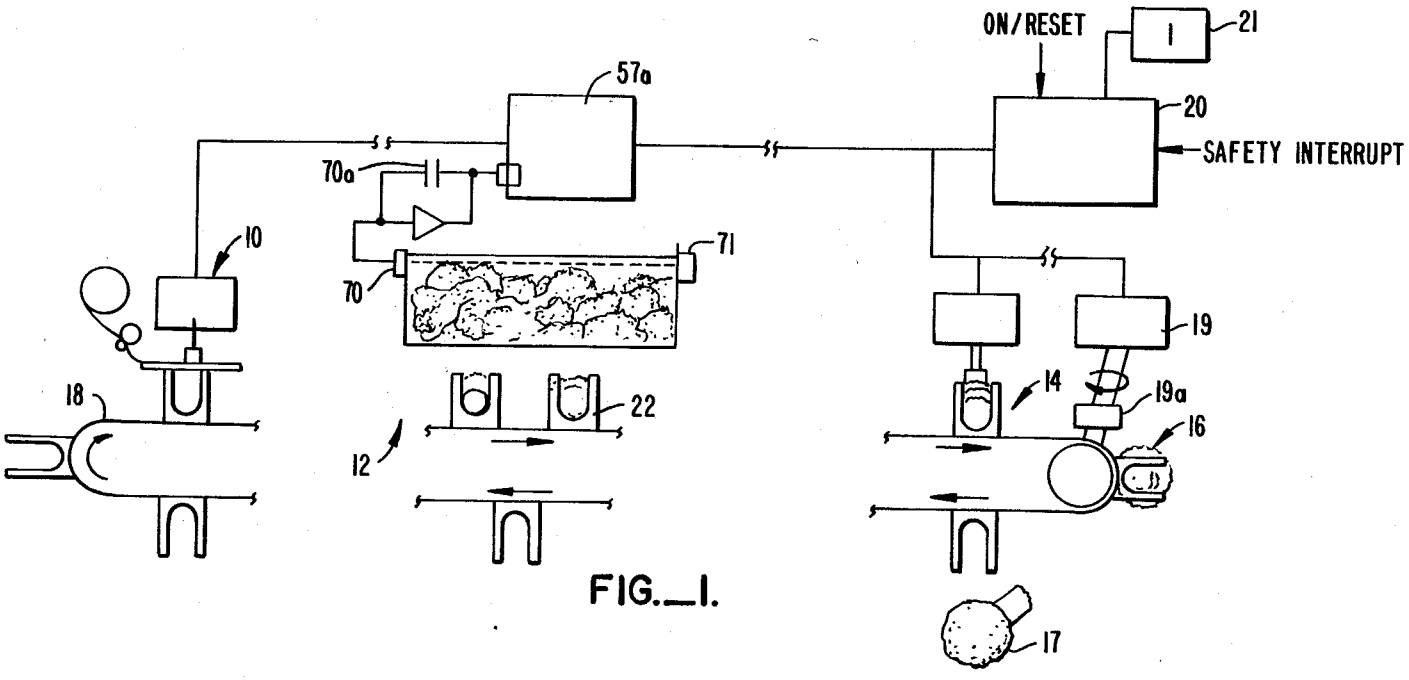
FIG. 1 is a schematic representation of a product tying machine according to the present invention.

A method and apparatus for bunching and tying a product is herein described. The apparatus (shown schematically in FIG. 1) includes a plurality of spaced product carriers 22 which are affixed to a conveyor flight 18 for movement about a conveyor circuit as indicated by the arrows in FIG. 1.

The product carriers sequentially pass by a first, or tie insertion station 10 wherein a product tie is inserted into each product carrier 22. The product carriers are then moved along conveyor flight 18 to a second or product inserting station 12 wherein a product is loaded into each of the product carriers 22. The product carrier is then moved along the conveyor circuit to a third or product tying station 14 wherein the product tie is secured about the product. Finally, the product carrier containing the tied product 17 is moved to a fourth or product discharge station 16 where it is delivered for further handling or packaging.

Operation of the conveyor flight is provided by a motive means 19 which may be an electric, hydraulic, or pneumatic motor. A mechanism 19*a* may be included between motive means 19 and conveyor flight 18 to convert a continuous motive force to intermittent motion for cyclic conveyor flight operation. Control of tie insertion station 10, product tying station 14, and conveyor motive means 19 is maintained by a control circuit 20. The speed at which the tying apparatus is run is selected by operation of rate controller 21. Control circuit 20 may be an arrangement of cams and sensors or it may be an electronic computing device.

Figure 1A:
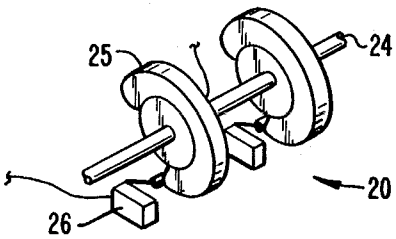
FIG. 1A is a perspective view of a control means for coordinating conveyor flight motion with operations at the tie-insertion station and product-tying station.

FIG. 1A shows an exemplary control means 20 including a cam shaft 24 for rotating a plurality of cams 25. The cams are spaced and are of an eccentric shape, such that they open and close actuators 26 in a predetermined sequence, corresponding to proper operation of the product tying apparatus. FIG. 1 also shows a "safety interrupt" input to the control means. The safety interrupt feature (discussed in detail below) stops operation of the entire machine in the event a machine operator is perilously close to the moving parts of the machine.

The present invention may also incorporate a "shear setting" safety device (not shown). Such devices are commercially available. In operation a shear setting device allows a machine to operate at normal torque. If an abnormal amount of machine torque is sensed—such as may be caused by jamming the machine with a hand or foreign object—then the machine is brought to a stop, thereby protecting the machine and the machine operator from injury.

The sequence of operation of the present invention is as follows:

(1) a tie is inserted into a product carrier;

(2) a product is inserted into the product carrier;

(3) the tie is secured about the product;

(4) the tied product is discharged to a product delivery system; and (5) the empty carrier is returned to the tie insertion station.

Once operation of the present invention has begun, the various stations operate in parallel. That is, as a tie is being inserted at tie insertion station 10, a product is being inserted at product insertion station 12 and a product is being tied at product tying station 14, etc. To this end, motive means 19 may be of an intermittent nature wherein the product carriers are advanced along the conveyor circuit a selected distance, at which point the conveyor enters into a stop or rest mode. It is during this time that all machine functions, e.g. the insertion, tying, are executed. After the rest period has elapsed, during which time a product is, presumably, inserted into a carrier, the spaced product carriers are then advanced again a similar distance.

Tie insertion station 10 (FIG. 2) provides a supply or roll 29 of a product tie 28. The tie is a known twist tie having a paper backed foil surface surrounding an internal wire. A foil surface tie is used in this embodiment of the invention because of its rich appearance. A plain paper tie with a single 24-gauge wire provides satisfactory performance for most applications to which the invention will be put. Tie type selection is generally a matter of choice and tie cost. In the exemplary embodiment of the invention, a 24-gauge wire twist tie is used, such as that manufactured by the Package Container Corporation of Canby, Oreg. Because the tie is supplied on a roll, the present invention may be operated through many tying sequences before additional twist tie material need be added. In normal operation, a roll of tie typically produces 2,000 product ties accounting for approximately one hour's production time. It takes about 30 seconds—1 minute to replace an exhausted tie roll with a fresh roll.

The tie on roll 29 is threaded through a series of tie guides/rollers 30*a–c*; the end of the tie is provided to a tie advance wheel 32. A shock absorber 101 focuses a moment of dead weight on roller 30*a* to damp the effect on tie demand by wheel 32 of tie roll 29 mass. A pinch roller 34 presses the tie against the tie advance wheel. The tie advance wheel has a knurled outer traction surface 33; the pinch roller has a vulcanized rubber outer roller surface 35. In this way, the tie is reliably advanced by the tie advance wheel/pinch roller assembly. In some embodiments of my invention at least one (but preferably three) O-ring is placed circumferentially about outer roller surface 35. Additionally, the pinch roller may be a capstan assembly. The tie advance wheel is operated by a motive means 36 that may be an electric, hydraulic, or pneumatic motor.

As the tie is advanced, it is guided into a tie holder assembly 42. The amount of tie advanced into tie holder assembly 42 may be determined by the circumference of tie advance wheel 32. However, tie length is not necessarily a function of wheel size but may be related to the number of wheel rotations, or fractions thereof, during a tie insertion cycle. Accordingly, different lengths of tie may be provided for binding different types of products into bundles.

After a selected amount of tie has been advanced by wheel 32, a cylinder 102 is actuated, forcing a tie cutting blade 41 against a cutting surface 41*a*. In this way the tie is reliably segmented. After the tie is cut, the blade is withdrawn.

After a tie has been inserted into tie holder 42, a tie holder cover 43, which forms a tie insertion channel 47 including an upper channel flange 43*a* and a lower channel flange 43*b* (refer to FIG. 3 for upper and lower channels), is withdrawn from the tie assembly (as shown by the arrows in FIG. 2) by a retractor means, such as pneumatic cylinder 48. Referring now to FIG. 3, the tie is maintained in position within the tie holder by a series of spaced magnets 102*a*/102*b*. The magnets attract the tie wire and thereby prevent undesirable movement of the tie during cover retraction. Magnets 102*a*/102*b*, shown in FIG. 3, are typically placed at both ends of the tie insertion gap.

Figure 2:
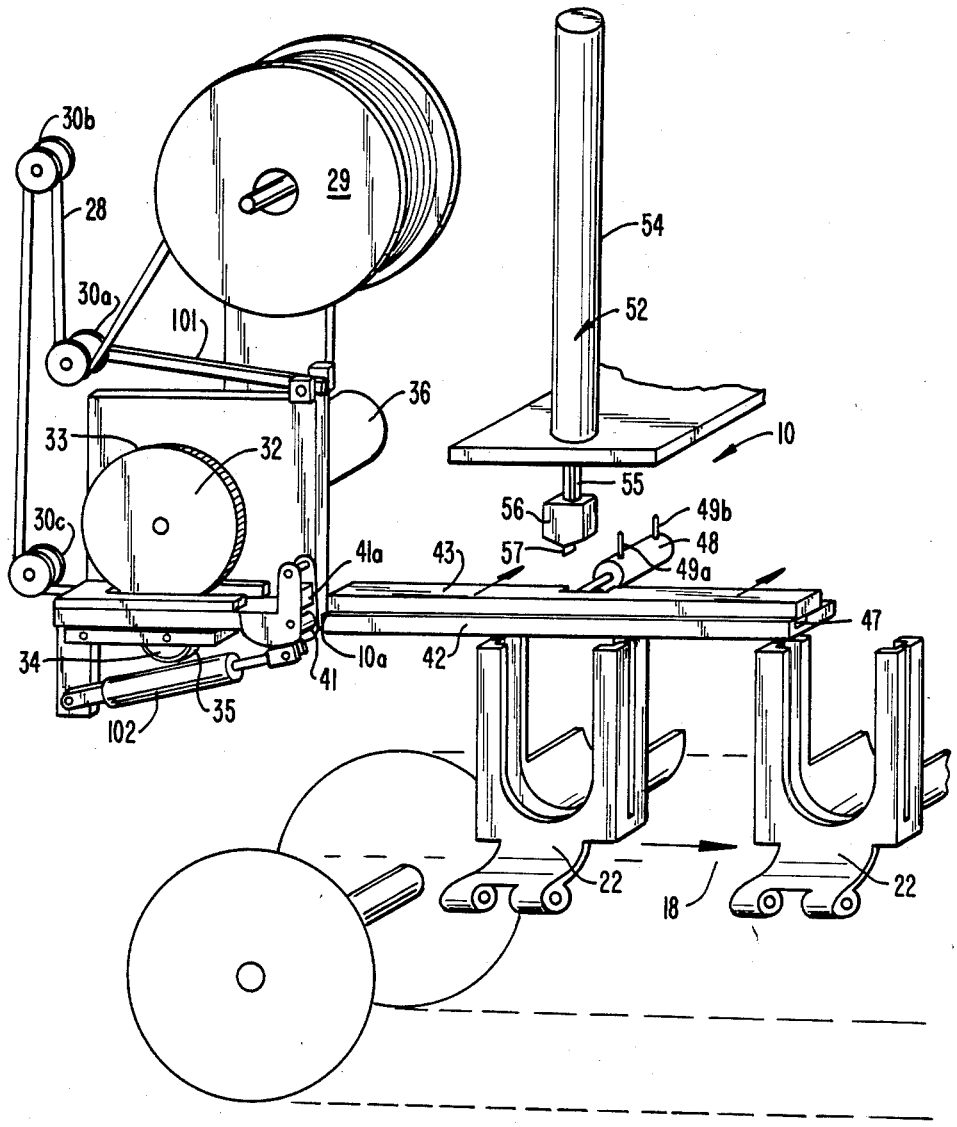
FIG. 2 is a perspective view of a tie dispensing and insertion station according to the present invention.
Figure 3:
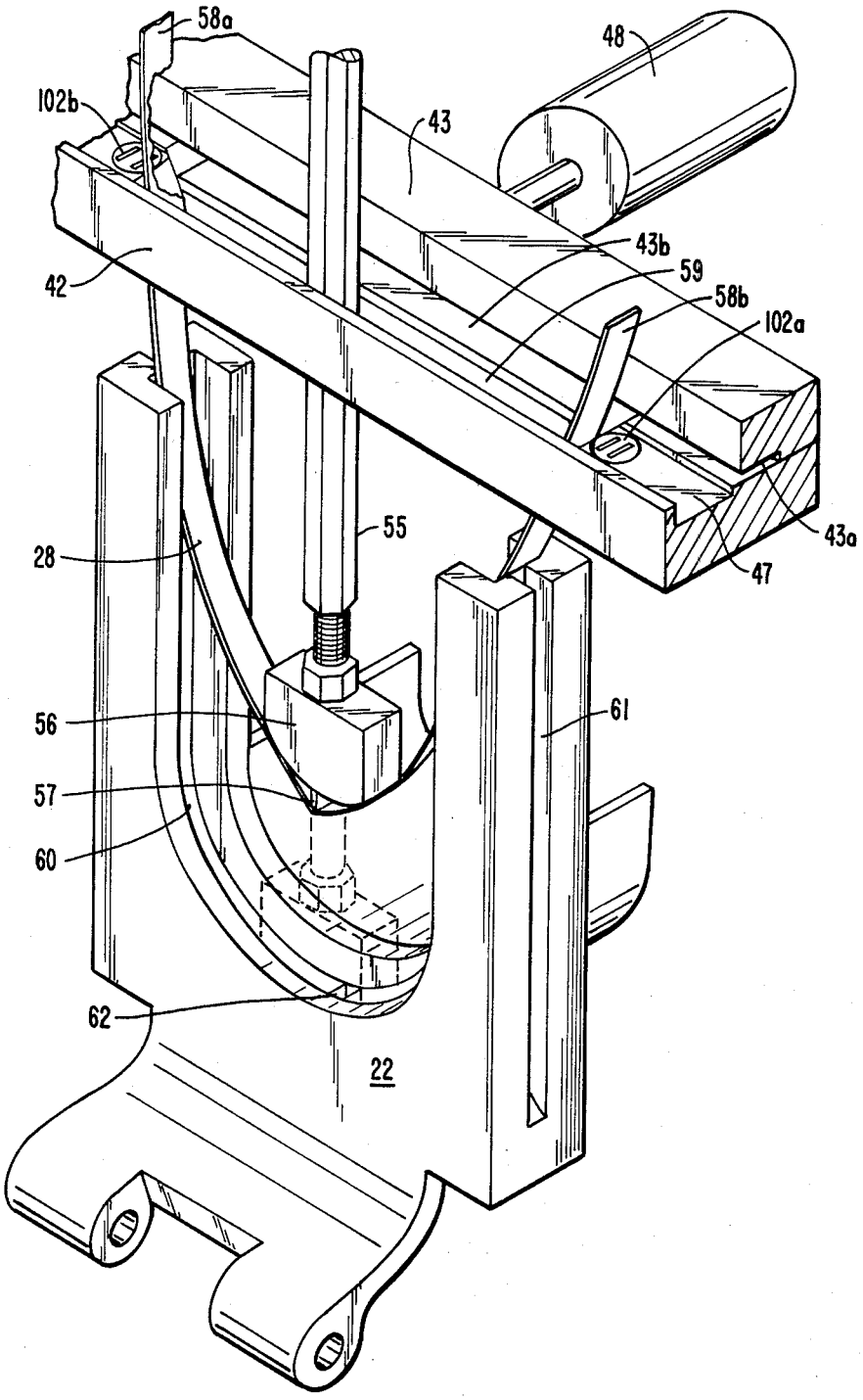
FIG. 3 is a detailed perspective view of a tie being inserted into a product carrier and showing completion of a tie insertion stroke in phantom.

The pneumatic cylinder shown in FIG. 2 includes two cylinder control lines 49*a*/49*b*. Although a pneumatic cylinder is shown, the retractor could as well be a hydraulic cylinder or an electro-mechanical device, such as a solenoid.

FIG. 2 also shows a plunger assembly 52 having a cylinder 54, a non-rotating shaft 55, and a tip 56, including a point 57. Referring now to FIG. 3, operation of plunger 52 is more readily understood, as is a tie insertion sequence.

In FIG. 3, tie holder 42 is shown with upper channel flange 43*a* and lower channel flange 43*b* in a withdrawn or retracted position as effected by operation of cylinder 48. When the flanges enclose the holder, tie holder channel 47 is formed, such that the tie is reliably inserted into the tie holder without bending or deforming. The height relation between tie holder 42 and a tie dispensing point 10*a* (FIG. 2) affects tie curl. Proper tie curl is essential if the tie is to be properly inserted into and retained within the product carrier. Upper channel flange 43*a* forms an upper channel portion and lower channel flange 43*b* encloses a tie insertion gap 59.

Each carrier 22 has a carrier channel 60 formed along an inner carrier surface and into which the tie is pressed. During a tie insertion stroke, shaft 55 is extended downwardly, pressing a tie 28 located in tie holder 42, and spanning tie holder gap 59, into product carrier channel 60. Shaft 55 must be maintained in precision alignment and is thus a hex, journaled, or other such non-rotating shaft. When shaft 55 is at its furthest extent downward, the shaft tip point 57 forces a portion of tie 28 into a carrier base indented slot 62. This action crimps or locks the tie into the carrier. Channel 60 assures that the tie is inserted into the carrier in an orderly and predictable manner and that it will not be dislodged during a product insertion; slotted indentation 62 assures that the tie is securely held within the carrier during the product insertion and tying process. In other embodiments of my invention the carrier base could have a projection and the tie tip could have a complementary indentation. The tie could also be held in place by a series of magnets located along product carrier channel 60.

Figure 4:
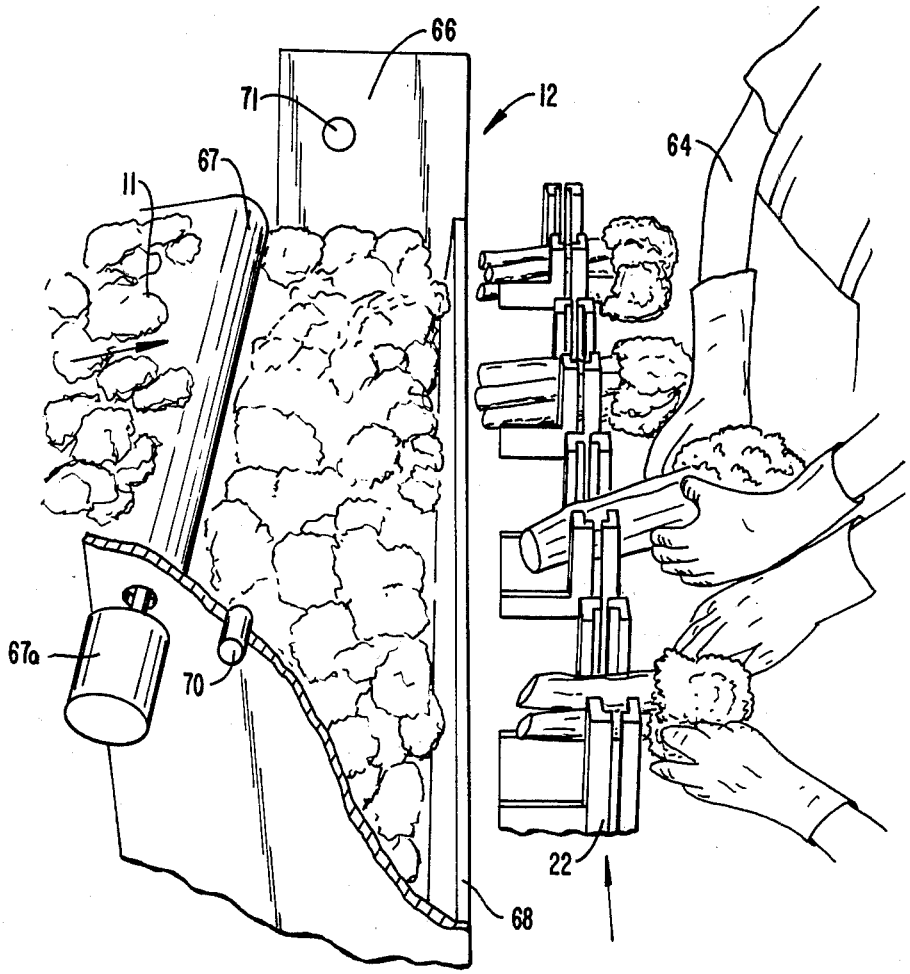
FIG. 4 is a perspective view of a product insertion station according to the present invention.

After the product tie is inserted into the product carrier, the product carrier is advanced along the conveyor flight circuit to product insertion station 12. As can be seen in FIG. 4, a product 11 is loaded from a truck or other such delivery means (not shown) and moved along a conveyor 67 for delivery into a loading station bin 66. The product is retained within the bin and the bin takes on the characteristics of a trough by inclusion of a loading or product retaining wall 68. Thus, a machine operator 64 may easily retrieve the product from bin 66 and place it in product carriers 22. The herein described embodiment of the invention provides a trough having a bottom constructed of 5/10" rods spaced at 2" intervals (not shown). This allows most produce debris to fall from the trough, thereby reducing the need to clean the trough of accumulated product debris. The trough may be alternatively constructed as its application requires.

In the exemplary embodiment of the invention, the product delivery conveyor 67 is set to deliver the product at a rate typically 4–5 times faster than that at which it may be removed from bin 66 and inserted into the product carriers. In this way, the bin is always maintained nearly full. Furthermore, in the event of product exhaustion, a new load may be quickly delivered for processing, without interrupting machine operation. In all cases, product delivery rate is a function of conveyor 67 speed, as further discussed below.

It is possible that the bin could overflow. To prevent such an occurrence, a product detection system, such as light source/photo-detector 70 and reflector 71, is included. When the product level in bin 66 approaches an overflow point, the product interrupts the reflection of the light source beam by reflector 71, and conveyor 67 is halted until the integrity of the beam reflected back to the photodetector is restored (by the removal of product for insertion into the carriers). To assure smooth operation of conveyor 67 a delay circuit 70*a* (FIG. 1) is included to increase the response time necessary to stop or start a conveyor motor 67*a* and thus stop or start the flow of product along conveyor 67 into bin 66. Both stop and start delays may be set independently, one from the other. Typically, the start delay period is longer than the stop delay period. This allows the operator to "catch up" with product flow (slow start) and prevents over-flow (fast stop).

Figure 5:
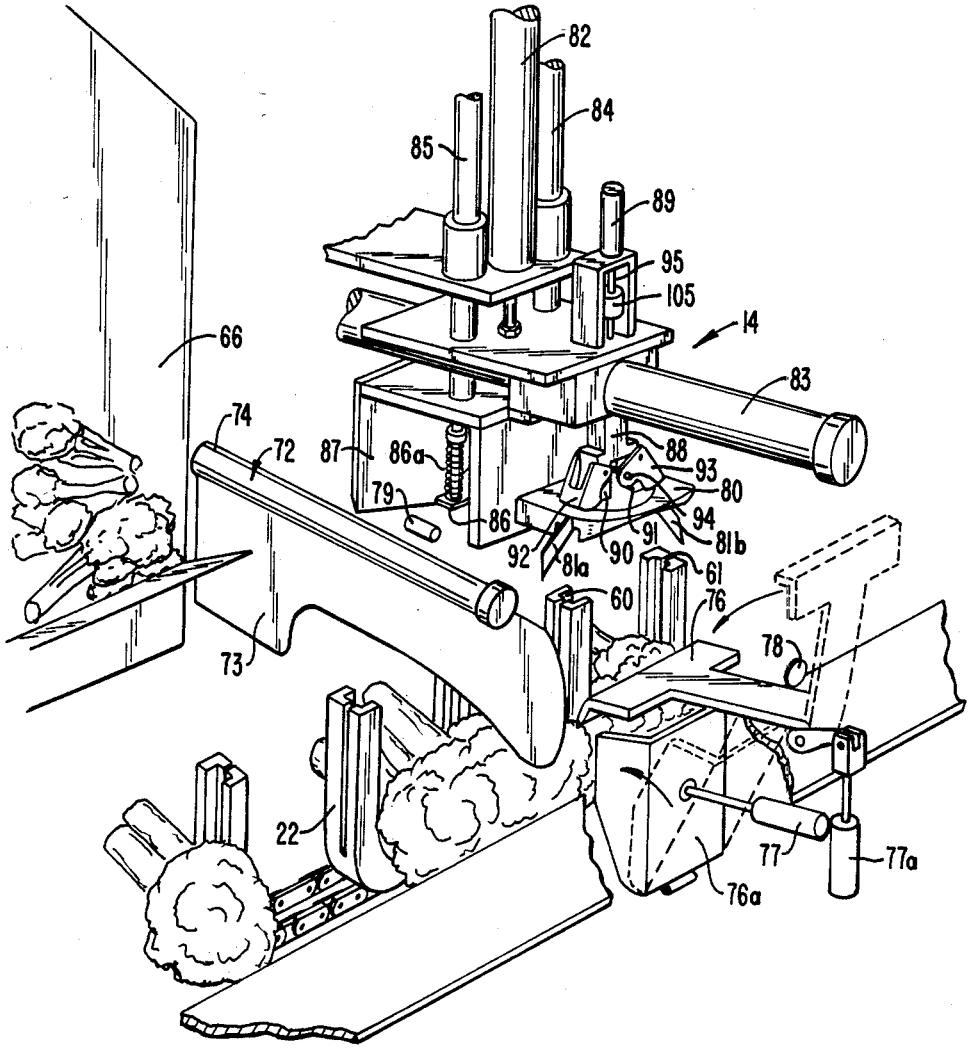
FIG. 5 is a perspective view of a product tying station according to the present invention.

From product insertion station 12, the product carriers containing the product and a product tie are moved along the conveyor circuit to product tying station 14 (FIG. 5). Product tying station 14 has several moving parts that could possibly injure a product tying machine operator, should the operator place a limb within the path of tying station operation. To prevent possible injuries, a safety barrier 72 is provided, including a safety shield 73 affixed to a shaft 74. Should an operator's limb contact shield 73 and displace it toward product tying station 14, shaft 74 will accordingly be pivoted, energizing a safety device (not shown), which in turn shuts down operation of the apparatus. The product tying machine will not resume operation after the safety feature has been tripped until the apparatus is reset at control means 20. In alternate embodiments of the present invention additional safety devices may be included, such as the previously discussed "shear setting" safety device, apparatus reset may not be required, and apparatus operation may be interrupted only locally (e.g. at the tying station only). Furthermore, emergency stops (panic buttons) may be located about the machine for operator selection of machine stop.

In the exemplary embodiment of the present invention the conveyor flight moves the product carriers sequentially about the conveyor circuit in an intermittent fashion. When a carrier containing a preinserted tie and a product is brought to product tying station 14, the conveyor is brought to a stop and the tie is secured about the product.

The product tying station includes a light source 79 which projects a beam of light across a path between the two upward projecting arms of the product carrier to a light detector 78. When a product is present in the carrier, the light beam is interrupted and product tying proceeds. When a product is not present in a product carrier, the light beam shines on light detector 78 and product tying does not occur but, rather, the empty product carrier is moved from the product tying station and the next product carrier (presumably containing a product) is advanced to the product tying station.

If a carrier containing a product is sensed at the product tying station, a product cradle 76*a* is brought to bear upon the product to thrust it forward to form the product into a compact, tight bunch. A product clamp 76 is activated shortly thereafter to hold the bunched product in position during the tying process. In applications where an agricultural product, such as broccoli, is bunched and tied, the product is loosely packed at the product insertion station. "Relaxed" product insertion allows an operator to insert the product more quickly without damaging it. Product forming at the tying station produces a tightly packed bunched product. Such a bundled product is easier to package and is more aesthetically pleasing in the market.

The product cradle and product clamp may be operated by any actuating means, such as pneumatic cylinders 77 and 77*a*, respectively. Typically, both cylinders are operated from a common actuator (not shown). The cradle cylinder is connected "first in line" such that is operates sooner than the clamp cylinder.

While the product is held by product clamp 76 and product cradle 76*a*, a product tie pick-up 80 is lowered downwardly toward the product carrier by action of cylinder 82, which is a pneumatic cylinder in the exemplary embodiment of the invention, but which may be a hydraulic or electro-mechanical device. As cylinder 82 lowers clamp assembly 88 and pick-up assembly 80 downwardly, a product saddle 86 is brought to bear on an opposite end of the product from that secured by product clamp 76 and product cradle 76*a*. Thus, the product is held securely at both ends during the tying process.

Figure 6:
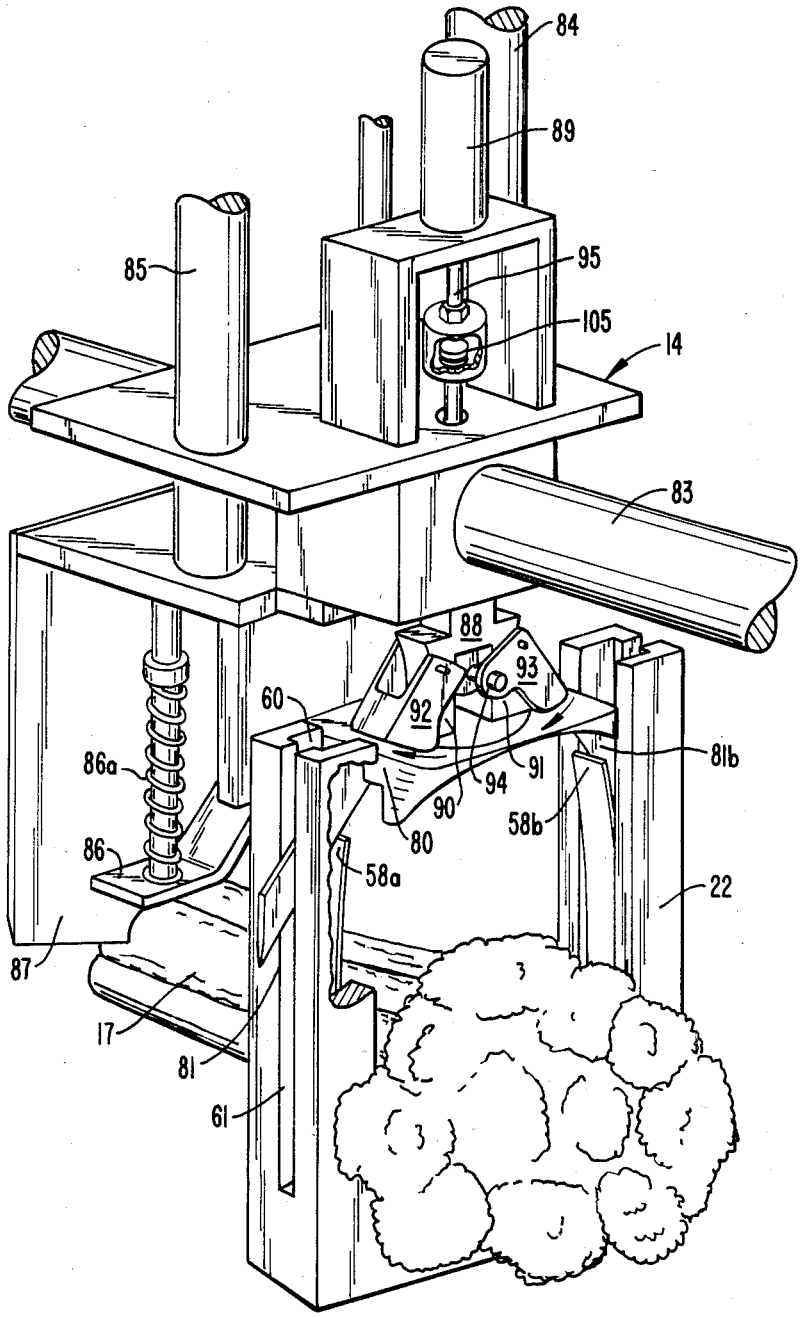
FIG. 6 is a detailed perspective view of a product tying station and tie end pick-up.

Product tie pick-up 80 includes a pair of blade like tines 81*a*/81*b*. Referring now to FIG. 6 it can be seen that tines 81*a* and 81*b* engage within a slot 61 that extends downward through the upward projecting arms of the product carrier.

Carrier slot 61 is oriented within the center of carrier channel 60. As the tie pick-up descends toward the carrier, pick-up tines 81*a*/81*b* displace a preinserted tie from within carrier channel 60, such that tie ends 58*a*/58*b* are guided along an inner tine surface and into engagement with a clamp assembly 88.

The tie ends are each guided into a separate set of clamp assembly jaws 90/92 and 91/93. As the tie pick-up and the clamp assembly descends, the tie ends continue to be engaged within a channel formed by the open clamp jaws. Once sufficiently engaged therein, a clamp actuating means, such as clamp cylinder 89, operates a cylinder shaft 95, coupled through a thrust bearing 105 to pivot 94, to pull clamp lever arms (jaws) 92/93 thereby closing each of the clamp jaws, which, in turn, secures tie ends 58*a*/58*b* therein.

To tie the tie about the product, clamp assembly 88 is rotated, thereby twisting the tie ends retained within the clamp jaws about the product. Clamp assembly rotation is accomplished by use of a pneumatic motor, such as rotary cylinder 83, although a hydraulic or electro-mechanical device may be substituted therefor.

Figure 7:
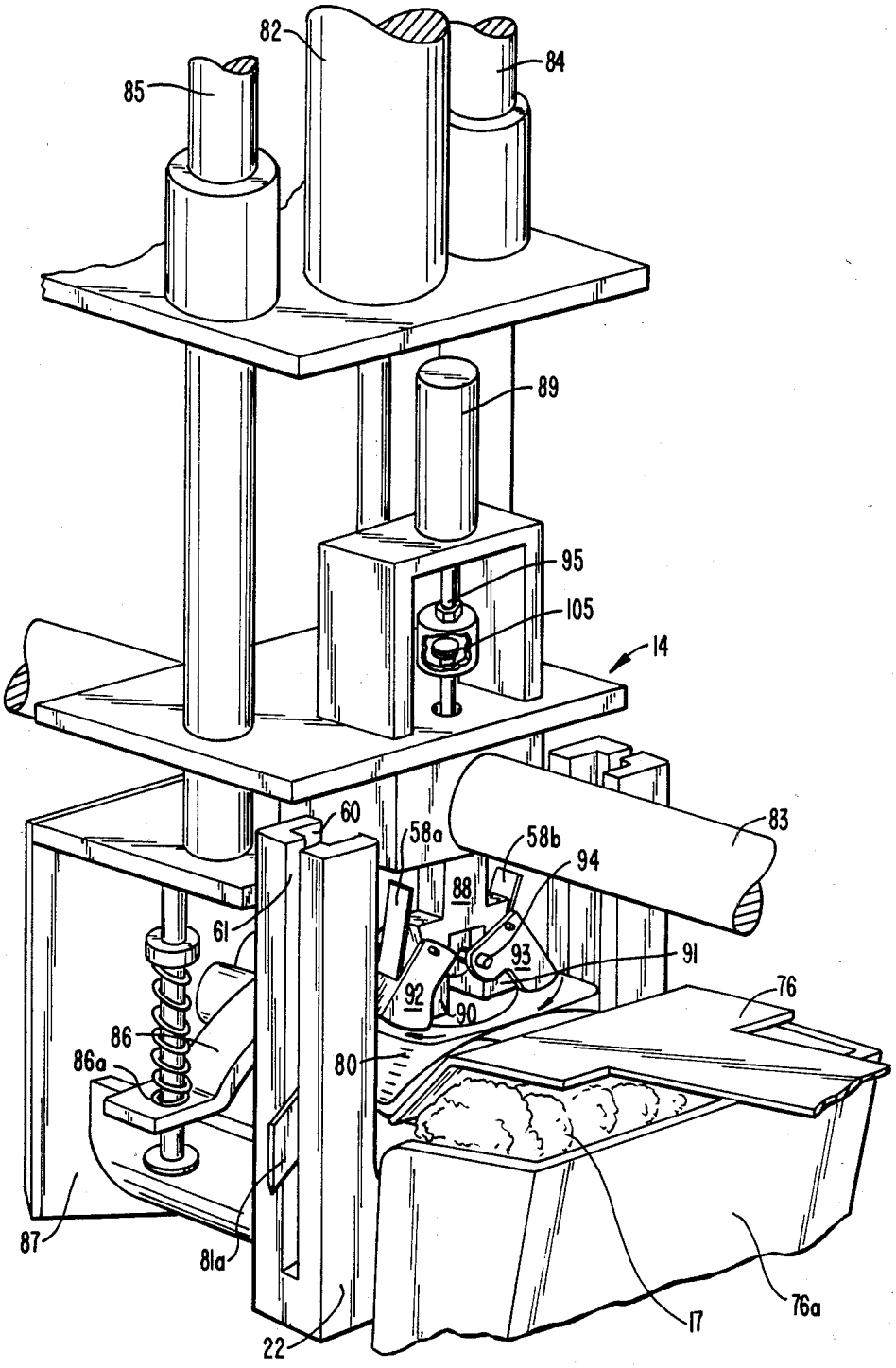
FIG. 7 is a detailed perspective view of the product tying station the end clamp.

After the product tie is secured about the product, clamp cylinder 89 unclamps the tie ends held within the clamp assembly jaws. Cylinder 89 is a double-acting cylinder. Pressure applied in a first direction clamps the clamp assembly; pressure applied in the opposite direction unclamps the clamp assembly. Now referring to FIG. 7, cylinder 82 operates in a similar manner, that is, the pressure in cylinder 82 is reversed allowing the tie pick-up and clamp assemblies to be forced upwardly along guiding shafts 84 and 85 from the product carrier. As the tie pick-up and clamp assemblies are moving upwardly and away from the now tied product, the product is held in position within the carrier, at both ends, by cooperating action of product clamp 76, product saddle 86, and spring 86*a*; clamp assembly 88 has not yet been returned back to its original position (prior to twisting the tie ends) by rotary cylinder 83. This arrangement assures that a product tie that may have been caught within clamp assembly 88 is removed therefrom without lifting the product from the product carrier. The arrangement also assures that the product tie is not untied when the clamp assembly is returned to its original position.

Figure 8:
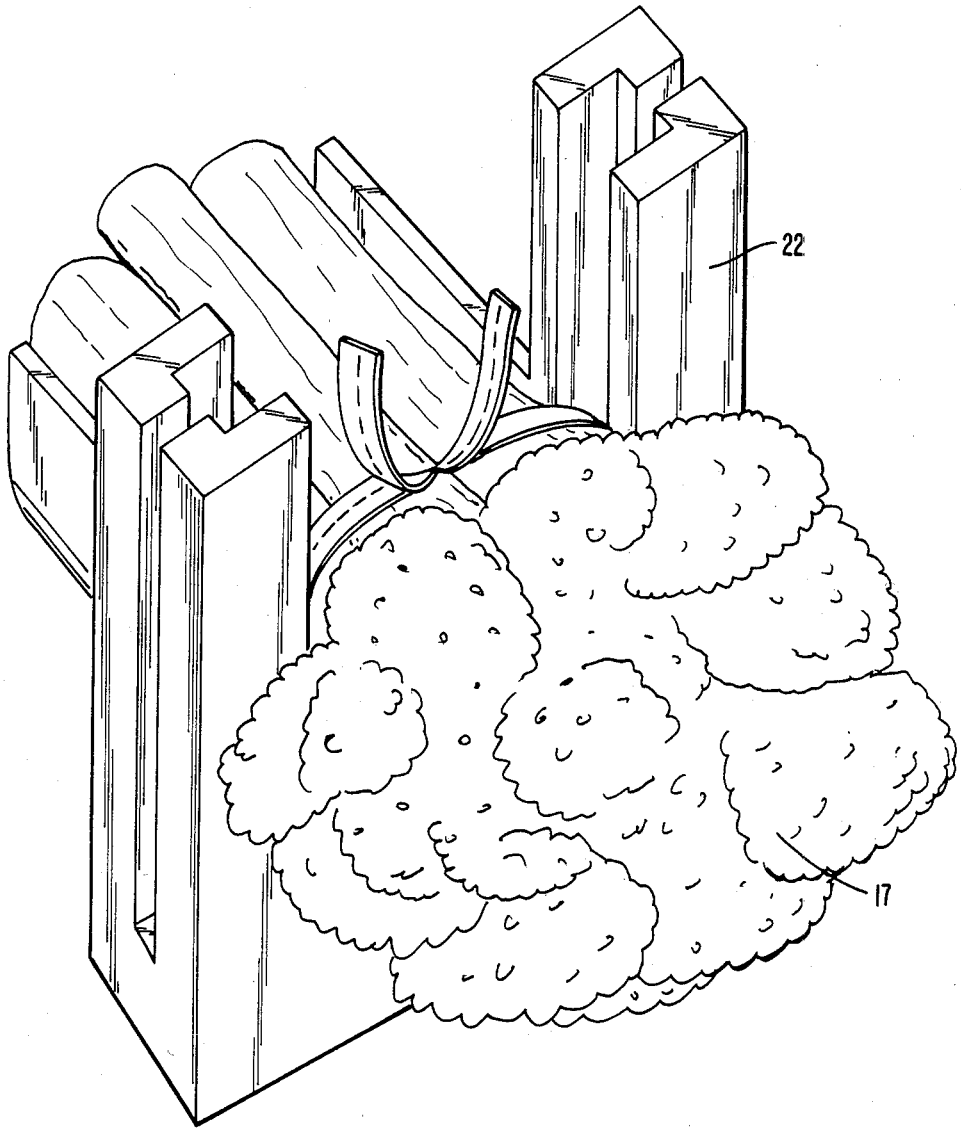
FIG. 8 is a perspective view of a product carrier containing product tied by the present invention.

After the clamp and tie pick-up assemblies are forced upward to their starting position, product clamp 76 is removed from the product, clamp assembly 88 is rotated back to its starting position, the product carrier containing the now tied product is moved along the conveyor circuit, and the next product carrier containing a product to be tied is brought to the product tying station. FIG. 8 shows a product carrier 22 containing a tied product 17 that has been processed by the present invention.

Although the invention may be used for various sorts of products having an elongated shape, such as bolts, spikes, etc., the exemplary embodiment of the invention is intended for agricultural products, and in particular, for broccoli, asparagus, or celery. To this end, a blade 87 (FIG. 7) is provided at the back of saddle 86. When the saddle is forced to bear upon the product during the product tying step, blade 87 is brought downwardly with sufficient force to trim the end of the product. In this way, the product is delivered from the product tying assembly in a bundle having a uniform and selected dimension, whereby product handling and packaging is further simplified. In the exemplary embodiment of the invention, saddle 86, blade 87, pickup 80, and clamping-twisting mechanism 88 are all brought to bear simultaneously by cylinder 82.

Figure 9:
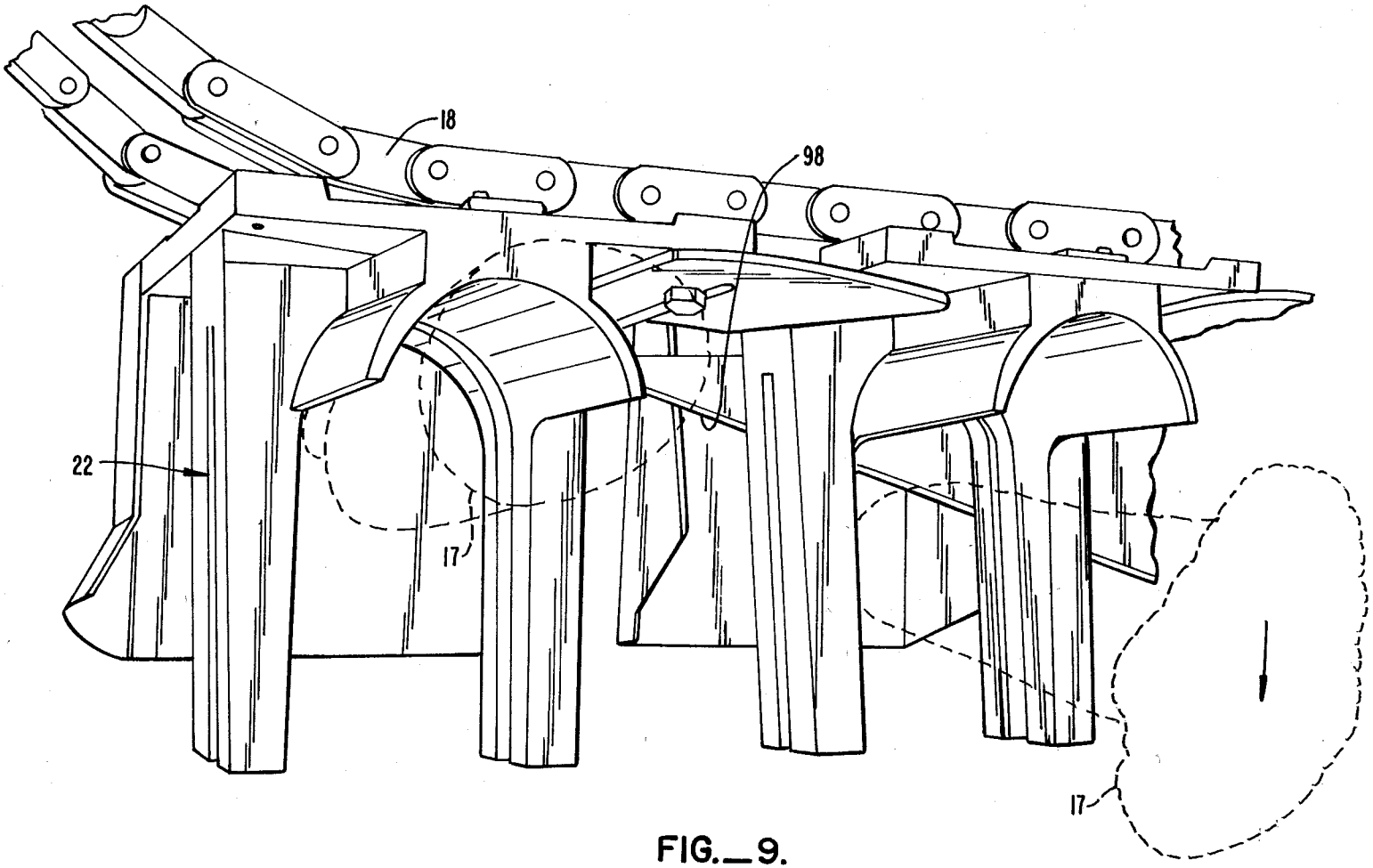
FIG. 9 is a perspective view of a product discharge and stripping station according to the present invention.

The tied product is moved from the product tying station to a product discharge station 16, where it is also used to drop from the product carrier, by force of gravity, onto a delivery conveyor or other such means (not shown) for further handling or packaging of the tied product. Occasionally a product does not drop from the product carrier when it is brought past the discharge station. To correct for this occasional occurrence a product stripper 98 (FIG. 9) is included. The product stripper provides a sloping or ramping edge. Movement of the product carrier along the return portion of the conveyor circuit pushes the product against the steadily increasing slope of the product stripper and forces (strips) the product from the carrier.

After product discharge and product stripping (if necessary) the empty product carriers are returned along a bottom flight portion of the product conveyor to complete the conveyor circuit by returning to the tie inserting station for tie insertion, at which point the procedure described above repeats.

Once operation of the present invention has begun, all stations operate in parallel. That is, as ties are being inserted into the carriers at the tie insertion station, product is being inserted into the carriers at the product insertion station, the tie is being secured about the product at the product tying station, and a tied product is being discharged from a carrier at the discharge station. The operation of the present invention establishes a rhythm at a rate which is selectable to pace that at which a product tying machine operator is inserting a product into the product carriers at the product insertion station. Because the operator has only to concentrate on one task—that of inserting the product into the product carrier—he can become adept at performing his task without distraction or interruption by a complicated process or series of tasks, such as those of bundling, tying, and discharging required by prior art machines. Because product delivery is controlled by the rate at which a product is inserted, the possibility of a machine operator producing an inadequately or poorly tied product or of product overflow due to machine operator inattention is eliminated. Additionally, by sensing the presence of product at a tying station, the potential for jamming the clamp assembly 88 or delivering empty product ties to the delivery station is eliminated. Rather, the product carrier is returned to the tie insertion station, another tie is inserted. Product may then be inserted, and both ties will be secured about the product.

The modular design of the present invention—arranging the product bunching and tying process into a series of sequential, logical steps—increases the efficiency of product bunching and tying, while simplifying construction and maintenance of the apparatus therefor. Coordination and control of the various product tying machine stations is from a central point; it is accomplished by either a cam and actuator arrangement (as shown in FIG. 1*a*) or by a computer operating with a suitable program. In the unlikely event of a mechanical failure at one of the machine stations, repair is a simple matter of unbolting the defective component from the machine and bolting a replacement component to the machine in its place. The modular design of the present invention eliminates most of the moving parts, gears, and timing problems inherent in other machines designed for this purpose.

The foregoing was given by way of illustration and example. It will be appreciated that the exemplary embodiment of the invention described herein is subject to modification and may be produced in various embodiments without departing from the scope and spirit of the subject matter claimed. For example, the actuators and cylinders may be of a pneumatic, hydraulic, or electromechanical nature; the size and shape of the carriers may be varied to accommodate various products; the intermittent nature of the conveyor may be a function of a mechanical relationship between the conveyor and its motive means (as accomplished by a geneva drive) or it may be a function of a timing circuit, etc.; the product sensors, both for the insertion station bin and for the tying station, may be a device other than a light source/photo-detector, such as a proximity detector, a product scale, etc. Therefore, the scope of the invention should be limited only by the claims.

I claim:

1. A product tying apparatus for use with a supply of wire twist ties, comprising:

means for sequentially conveying a plurality of spaced carriers along a conveyor flight;

means, located at a first station along said flight, for inserting a wire twist tie into each spaced carrier;

a second station located along said flight wherein a product may be inserted into each spaced carrier; and means, located at a third station along said flight, for twisting the wire twist tie in each spaced carrier securely about the product inserted therein.

2. The apparatus of claim 1, said second station further comprising:

delivery means for providing a controlled product flow to said second station at a rate commensurate with that of product insertion into said carriers.

3. The apparatus of claim 2, further comprising:

means for delivering said carriers to said third station at a selectable rate commensurate with that of product insertion into said carriers.

4. The apparatus of claim 3, further comprising:

means for intermittently operating said conveyor flight at a selected rate in coordination with the rate of product insertion into said carriers.

5. The apparatus of claim 1, further comprising:

control means in communication with said conveying means, said tie inserting means, and said securing means, for coordinating tie insertion, product insertion, and product tying one with each other.

6. A product tying apparatus, comprising:

a plurality of U-shaped product carriers;

a conveyor flight having said carriers spacedly affixed thereto for sequential movement about a conveyor circuit;

a first station located along said conveyor circuit wherein a product tie is inserted into each carrier, said first station including:

(a) a continuous tie supply source;

(b) a tie holder having a retractable cover for exposing a tie insertion gap;

(c) means for inserting a strip of tie from said tie supply source into said tie holder;

(d) means located between said feeding means and said tie holder for cutting said tie from said tie supply after tie insertion into said tie holder;

(e) means for retracting said tie holder cover to expose said tie insertion gap; and (f) means for inserting said tie into said carrier;

a second station located along said conveyor circuit wherein a product may be inserted into each spaced carrier, including:

(a) a product holding bin at said second station; and (b) product sensing means for controlling product flow to said second station as a function of the rate at which said product is removed from said holding bin for insertion into said carriers; and a third station located along said conveyor circuit wherein the tie inserted into each carrier is secured about the product inserted therein, including:

(a) pick-up means for guiding two tie ends into a tie pick-up position;

(b) clamp means having a pair of spaced opposing jaws for grabbing each of said tie ends;

(c) means for rotating said clamp means about a tie axis to twist the clamped tie ends securely about said product; and (d) means for removing said clamp means from said tie ends after said product is tied.

7. The apparatus of claim 6, further comprising:

control means for coordinating conveyor operation, tie insertion, product insertion, and product tying one with each other.

8. The apparatus of claim 7, said control means further comprising:

a plurality of servo means having coordinated operation for controlling conveyor operation, tie insertion, product insertion, and product tying.

9. The apparatus of claim 8, said servo means further comprising:

pneumatically actuated controllers; and cam actuated valves for operating said controllers.

10. The apparatus of claim 8, said servo means further comprising:

electrically actuated controllers; and cam actuated switches for operating said controllers.

11. The apparatus of claim 6, said tie holder retractable cover further comprising:

an upper and lower cover flange forming a tie insertion channel.

12. The apparatus of claim 11, said tie holder further comprising:

magnet means for retaining a tie to said tie holder during holder retraction.

13. The apparatus of claim 6, said strip inserting means further comprising:

a tie feed wheel;

a pinch roller for forcing said tie against said feed wheel; and means for rotating said feed wheel to advance said tie into said tie holder.

14. The apparatus of claim 13, wherein said feed wheel is knurled.

15. The apparatus of claim 6, each of said carriers further comprising:

a channeled inner U-shaped surface including a slotted depression formed substantially perpendicular to said channel at a carrier inner carrier base portion.

16. The apparatus of claim 15, said inserting means further comprising:

an elongated shaft extensible along an axis transverse to said tie insertion gap wherein a tie spanning said gap is forced into said channelled U-shaped carrier inner surface.

17. The apparatus of claim 16, said inserting means further comprising:

a tie insertion tip having a broad flat tie insertion surface including a tie locking point for forcing a portion of said tie into said slotted carrier depression to secure it therein.

18. The apparatus of claim 6, said product sensing means further comprising:

a light path including a photo-detector and a light source wherein product flow to said second station is a function of light path integrity.

19. The apparatus of claim 18, said product sensing means further comprising:

means for delaying product flow response to interruption of said light path integrity.

20. The apparatus of claim 6, each of said carriers further comprising:

a base portion;

a pair of parallel, substantially vertical product cradles projecting upwardly from said base portion;

a channeled U-shaped inner surface extending from a first of said cradles across said base portion to the other cradle; and a slot substantially perpendicular to said channeled surface and extending from an outer carrier surface to said channeled U-shaped cradle inner surface.

21. The apparatus of claim 20, wherein a tie is inserted into each U-shaped carrier's inner surface channels; and wherein said pick-up means further comprises a pair of pick-up tines, each of said tines being engageable within said transverse slot for guiding the two tie ends into a tie pick-up position.

22. The apparatus of claim 6, said third station further comprising:

means for retaining said product within said carrier while the tie inserted into each carrier is secured about the product.

23. The apparatus of claim 22, wherein said product is a food product, said third station further comprising:

means for trimming said product to a selected dimension.

24. The apparatus of claim 6, further comprising:

safety means for interrupting apparatus operation when an operator's limb is perilously close to said third station.

25. The apparatus of claim 6, said third station further comprising:

means for detecting an empty carrier and for interrupting third station operation in response thereto.

26. The apparatus of claim 6, further comprising:

means for intermittently advancing said carriers from station to station about said conveyor circuit at a selected rate.

27. The apparatus of claim 6, further comprising:

a fourth station located along said conveyor circuit for delivering said tied products for further transport and handling.

28. The apparatus of claim 27, further comprising:

means for stripping said tied products from an associated carrier.

29. The apparatus to claim 6, said third station further comprising:

cradle means for forming said product into a compact bunch.

30. A method of securely tying a product with a wire twist tie, comprising the steps of:

sequentially conveying a plurality of spaced carriers along a conveyor flight;

inserting a wire twist tie into each of said spaced carriers with a tie insertion apparatus;

inserting a product into each spaced carrier; and automatically twisting said wire twist tie in each spaced carrier securely about the products inserted therein with a tie securing apparatus.

31. The method of claim 30 further comprising:

delivering a controlled flow of said product to a product insertion station at a rate commensurate with that of product insertion into said carriers.

32. A product tying method, comprising:

sequentially moving a plurality of U-shaped product carriers about a conveyor circuit;

inserting a strip of tie from a tie supply source into a tie holder;

cutting said tie from said tie supply source after tie insertion into said tie holder;

retracting a tie holder cover to expose a tie insertion gap;

inserting said tie into one of said carriers;

inserting a product into each spaced carrier;

guiding two tie ends into a tie pick-up position;

grabbing each of said tie ends within a pair of spaced opposing clamp jaws;

rotating said clamp jaws about a tie axis to twist the tie ends securely about said product; and removing said clamp jaws from said tie ends after said product is tied.

33. The method of claim 30, further comprising:

locking said tie into said carrier during said tie insertion.

34. A method of claim 32, wherein said product is a food product, further comprising:

trimming said product to a selected dimension.

35. The method of claim 34, further comprising:

forming said product into a compact bunch; and retaining said product within said carrier while said tie is secured about said product.

36. The method of claim 32, further comprising:

intermittently advancing said carriers about said conveyor circuit at a selected rate.

37. The method of claim 36, further comprising:

stripping said tied products from an associated carrier; and delivering said tied products to a receiving station for further transport and handling.

38. A product tying apparatus, comprising:

means for sequentially conveying a plurality of spaced carriers along a conveyor flight;

means, located at a first station along said flight, for inserting a tie into each spaced carrier;

a second station located along said flight wherein a product may be inserted into each spaced carrier, said second station comprising delivery means for providing a controlled product flow to said second station at a rate commensurate with that of product insertion into said carriers, said delivery means comprising:

a product holding bin at said second station; and product sensing means for controlling product flow to said second station as a function of the rate at which said product is removed from said holding bin for insertion into said carriers; and means, located at a third station along said flight, for securing the tie in each spaced carrier about the product inserted therein.

* * * * *